US011808023B2

(12) United States Patent
Lin et al.

(10) Patent No.: US 11,808,023 B2
(45) Date of Patent: Nov. 7, 2023

(54) SPRAY WASHING COMPONENT FOR SMART TOILET COVER AND ASSEMBLY METHOD OF SPRAY WASHING COMPONENT

(71) Applicant: KOMOO INTELLIGENT TECHNOLOGY CO., LTD., Fujian (CN)

(72) Inventors: Xiaofa Lin, Fujian (CN); Xiaoshan Lin, Fujian (CN); Shan Lin, Fujian (CN); Guangyong Chen, Fujian (CN); Zuhua Liu, Fujian (CN)

(73) Assignee: KOMOO INTELLIGENT TECHNOLOGY CO., LTD., Fujian (CN)

( * ) Notice: Subject to any disclaimer, the term of this patent is extended or adjusted under 35 U.S.C. 154(b) by 0 days.

(21) Appl. No.: 17/776,601

(22) PCT Filed: Apr. 28, 2020

(86) PCT No.: PCT/CN2020/087370
§ 371 (c)(1),
(2) Date: May 13, 2022

(87) PCT Pub. No.: WO2021/179413
PCT Pub. Date: Sep. 16, 2021

(65) Prior Publication Data

US 2022/0389699 A1 Dec. 8, 2022

(30) Foreign Application Priority Data

Mar. 10, 2020 (CN) ..... 202010162776.9

(51) Int. Cl.
*E03D 9/08* (2006.01)
*B05B 15/68* (2018.01)

(52) U.S. Cl.
CPC ..... *E03D 9/08* (2013.01); *B05B 15/68* (2018.02)

(58) Field of Classification Search
CPC ..... E03D 9/08
(Continued)

(56) References Cited

U.S. PATENT DOCUMENTS 11,253,114 B2 * 2/2022 Schwab ..... A47K 10/48
2018/0044903 A1 * 2/2018 Schwab ..... A47K 13/302

FOREIGN PATENT DOCUMENTS

CN 201033895 3/2008
CN 205776627 12/2016
(Continued)

OTHER PUBLICATIONS

"International Search Report (Form PCT/ISA/210) of PCT/CN2020/087370," dated Dec. 2, 2020, with English translation thereof, pp. 1-4.

(Continued)

*Primary Examiner* — Lori L Baker
(74) *Attorney, Agent, or Firm* — JCIPRNET

(57) ABSTRACT

A spray washing component for a smart toilet cover and an assembly method thereof are provided. The spray washing component includes a base, a nozzle, and a first motor. A sliding track is disposed on the base. The nozzle has a rack cooperating with the first motor. The first motor drives the nozzle to slide along the base. The first motor is installed at an end away from a jet of the nozzle and drives the nozzle to be displaced through a transmission structure. The transmission structure includes a driving gear, a dual transmission gear, and a conveyor belt. The driving gear is in anti-rotation cooperation with an output shaft of the first motor. The dual transmission gear respectively meshes with the conveyor belt and the rack on the nozzle. The spray
(Continued)

washing component and the assembly method solve the large space occupation and insufficient aesthetics of the existing toilet.

13 Claims, 9 Drawing Sheets

(58) Field of Classification Search
USPC ..... 4/420.4, 420, 447–448
See application file for complete search history.

(56) References Cited

FOREIGN PATENT DOCUMENTS

| | | |
|---|---|---|
| CN | 106677308 | 5/2017 |
| CN | 107178129 | 9/2017 |
| JP | H08326127 | 12/1996 |
| JP | 2009161936 | 7/2009 |
| JP | 2020029764 | 2/2020 |
| KR | 20050082178 | 8/2005 |
| KR | 100586658 | 6/2006 |
| KR | 100762656 | 10/2007 |

OTHER PUBLICATIONS

"Search Report of Europe Counterpart Application", dated Mar. 1, 2023, p. 1-p. 13.
Office Action of Japan Counterpart Application, with English translation thereof, dated May 30, 2023, pp. 1-6.

* cited by examiner

SPRAY WASHING COMPONENT FOR SMART TOILET COVER AND ASSEMBLY METHOD OF SPRAY WASHING COMPONENT

CROSS-REFERENCE TO RELATED APPLICATION

This application is a 371 of international application of PCT application serial no. PCT/CN2020/087370, filed on Apr. 28, 2020, which claims the priority benefit of China application no. 202010162776.9, filed on Mar. 10, 2020. The entirety of each of the above mentioned patent applications is hereby incorporated by reference herein and made a part of this specification.

TECHNICAL FIELD

The disclosure relates to the field of sanitary ware, and is particularly related to a spray washing component for a smart toilet and an assembly method of the spray washing component.

DESCRIPTION OF RELATED ART

Nowadays, with the popularization of intelligence, smart toilet covers are widely used in various places such as homes and public places.

Although the functions of the existing smart toilet covers are gradually improved, there are still shortcomings in terms of details. For example, the existing smart toilet cover has a large overall volume, especially a large thickness, lacks overall aesthetics, and is inconvenient to use. The specific reason for aforesaid shortcomings is that the overall height of the smart toilet cover depends on the height of the nozzle. The extending or retracting of the nozzle from the inside of the smart toilet cover needs to be driven by a motor. The gear on the motor meshes with the rack on the nozzle to drive the nozzle to slide relative to the housing. The structure causes the motor to be disposed close to the water outlet to drive the displacement of the nozzle. Therefore, the height composed of the overall height of the nozzle and the size of the motor is the most basic height of the smart toilet cover, so the existing smart toilet cover is very thick and has poor aesthetics. In addition, since the motor of the smart toilet cover is close to the jet of the nozzle, the motor may be easily damp and damaged, thereby seriously affecting the service life thereof.

In summary, there is still room for improvement for the existing spray washing components of the smart toilet covers.

SUMMARY

The following is a summary of the subject described in detail in the disclosure. The summary is not intended to limit the protection scope of the claims.

An embodiment of the disclosure provides a spray washing component for a smart toilet cover, which includes a base, a nozzle, and a first motor. A sliding track is disposed on the base. The nozzle has a rack cooperating with the first motor. The first motor drives the nozzle to slide along the base. The first motor is installed at an end away from a jet of the nozzle and drives the nozzle to be displaced through a transmission structure. The transmission structure includes a driving gear, a dual transmission gear, and a conveyor belt. The driving gear is in anti-rotation cooperation with an output shaft of the first motor. The dual transmission gear respectively meshes with the conveyor belt and the rack on the nozzle. The conveyor belt is disposed around the driving gear and the dual transmission gear. The first motor drives the driving gear to rotate and links the dual transmission gear to rotate through the conveyor belt to drive the nozzle to move along the sliding track of the base.

Further, a water diversion unit is also included. The water diversion unit includes a water and air intake member, a switch body, and a self-cleaning connector. The nozzle is provided with several waterways. Water inlets of the several waterways could be selectively conducted with a water outlet of the switch body. The water and air intake member is communicated with the switch body through a first hose. The self-cleaning connector is communicated with one of the waterways of the nozzle through a second hose. A curved section of the first hose is located on an outer side of a curved section of the second hose.

Further, the base is provided with an accommodating cavity for partially placing the first and second hoses. A width of the accommodating cavity is greater than or equal to an outer diameter of a hose with a largest diameter and is less than a sum of outer diameters of the two hoses.

Further, a length of the first hose is greater than a length of the second hose.

Further, a second motor is also included. The second motor is disposed on the nozzle and is used to drive the switch body to displace relative to the nozzle. A conductive wire of the second motor is arranged side by side without being staggered with the first and second hoses and is located on an outer side of the curved section of the first hose.

Further, a wire harness structure is also included. The wire harness structure is used to limit a length of the conductive wire. The wire harness structure includes a wire buckle and an accommodating groove. The accommodating groove is formed on a bottom portion of the base. The wire buckle is slidably sleeved on the conductive wire and is installed on the accommodating groove to adjust the length of the conductive wire from the wire buckle to the second motor.

Further, the water and air intake member is disposed at a middle position of the bottom portion of the base and is located between the first motor and the jet of the nozzle.

Further, the water and air intake member includes a water outlet part, a water inlet part, an air inlet part, a holding part, a connecting part, and a position-limiting protrusion. The water inlet part and the air inlet part are located on one side of the water outlet part, the connecting part and the position-limiting protrusion formed on the connecting part are connected to other side of the water outlet part through the holding part, and the water inlet part, the air inlet part, the holding part, and the position-limiting protrusion are parallel to each other and are all perpendicular to an axial direction of the water outlet part. The connecting part is parallel to an axis of the water outlet part. The water and air intake member is installed on the base through an attachment structure, and the holding part abuts against the conveyor belt to tension the conveyor belt.

Further, the attachment structure includes an assembly groove and an assembly hole. The assembly groove and the assembly hole are respectively disposed on two sidewalls of the accommodating cavity. The assembly hole is provided for the position-limiting protrusion to be installed. The assembly groove is provided for the water inlet part and the air inlet part to be installed and includes an opening and first and second ends. The opening is disposed on a bottom portion of a sidewall of the base, and the opening and the first and second ends constitute a triangular assembly groove. The first end is provided for the air inlet part or the water inlet part to be installed. The second end is provided for the water inlet part or the air inlet part to be installed.

An embodiment of the disclosure also provides an assembly method of a spray washing component. The spray washing component includes a base, a motor, a conveyor belt, a nozzle, and a water and air intake member. The base has an accommodating cavity for the conveyor belt to be placed. The motor is installed on the base and drives the nozzle to slide relative to the base through the conveyor belt. An assembly groove and an assembly hole are disposed on two sidewalls of the accommodating cavity. The assembly groove includes an opening and first and second ends. The opening is opened on an edge of a sidewall of the base and constitutes a triangular assembly groove with the first and second ends. The water and air intake member includes a water outlet part, a water inlet part, an air inlet part, a holding part, a connecting part, and a position-limiting protrusion. The water inlet part and the air inlet part are located on one side of the water outlet part, the connecting part and the position-limiting protrusion are connected to other side of the water outlet part through the holding part, and the water inlet part, the air inlet part, the holding part, and the position-limiting protrusion are parallel to each other and are all perpendicular to an axial direction of the water outlet part. The connecting part is parallel to an axis of the water outlet part. The assembly method includes the following steps. The water inlet part and the air inlet part of the water and air intake member sequentially enter the assembly groove from the opening until the water inlet part is displaced to the first end, the air inlet part is also located between the opening and the second end, and the water outlet part, the holding part, the connecting part, and the position-limiting protrusion are located in the accommodating cavity. The water and air intake member is rotated with an axis of the water inlet part as an axis, so that the air inlet part enters the second end of the assembly groove, and the connecting part elastically deforms and links the position-limiting protrusion to fall into the assembly hole. At this time, the holding part abuts against an outer wall of the conveyor belt to tension the conveyor belt.

From the above description of the disclosure, it can be seen that compared with the prior art, the disclosure has the following beneficial effects.

1. The technical solution provides the spray washing component for the smart toilet and the assembly method of the spray washing component. The structure is simple, easy to manufacture, and easy to implement. The first motor is placed behind the base and drives the nozzle through the transmission structure, so that the nozzle slides relative to the base. The design protects the first motor. Also, the thickness of the toilet cover only needs to meet the height of the nozzle, so the overall thickness can be greatly reduced to implement a smart toilet cover that occupies a small space and is exquisite.

2. According to the disclosure, the water diversion unit is added, so that the nozzle has multiple rinsing functions. The switch body and the water and air intake member of the water diversion unit are communicated by using the first hose, and the curved section of the first hose is located on the outer side of the curved section of the second hose (that is, the two hoses are arranged up and down), so that the volume of the base can be reduced (that is, the width of the base is reduced), so that the volume of the entire spray washing component is reduced, thereby reducing the thickness of the smart toilet.

3. The width of the accommodating cavity of the base of the disclosure is greater than or equal to the outer diameter of the hose with the largest diameter and is less than the sum of the outer diameters of the two hoses, and the length of the first hose is greater than the length of the second hose. Specifically, during the movement process of the nozzle, the first and second hoses are stretched or bent along with the nozzle. The structure can ensure that the direction of stretching or bending of the two hoses is consistent with the direction of the nozzle when the two hoses perform the sliding movement along with the nozzle, and the first and second hoses maintain relative positions when bent or stretched. Therefore, it is effective to ensure that the first and second hoses are not entangled with each other, and the hoses will not be staggered, thereby ensuring smooth movement and preventing the hoses from being staggered to affect the normal operation of the spray washing component.

4. The disclosure adopts the second motor to drive the switch body in the water diversion unit, and the switch body corresponds to any waterway on the nozzle to conduct the outflow of the waterway. The conductive wire of the second motor is arranged side by side without being staggered with the first and second hoses and is located on the outer side of the curved section of the first hose. The arrangement enables the conductive wire and the first and second hoses to be parallel and maintain relative positions when the second motor slides along with the nozzle, thereby preventing the first and second hoses and the conductive wire from being staggered and entangled.

5. The disclosure also provides the wire harness structure. The length of the conductive wire between the wire buckle and the second motor is adjusted through the wire harness structure to prevent the conductive wire from being entangled with the first and second hoses when the conductive wire is too long or too short.

6. The water and air intake member of the disclosure is disposed between the bottom portion of the base and is located between the first motor and the jet of the nozzle, so that the lengths of the first and second hoses are the shortest. If the water and air intake member is close to the jet of the nozzle, the first and second hoses will be too long. If the water and air intake member is close to the first motor, the first and second hoses will be arched when moving along with the nozzle, which occupies a lot of space.

7. The water and air intake member of the disclosure is installed on the base and is located near the conveyor belt. Through the attachment structure, the water and air intake member can still hold the conveyor belt to tighten the conveyor belt in the case where the water and air intake member is installed and fixed. The design not only has a compact structure and an ingenious layout, but also implements one object with two functions, ensures the effective transmission between the first motor and the nozzle, and implements smart and precise control.

8. In the disclosure, the assembly groove and the assembly hole are disposed on the sidewall of the accommodating cavity of the base, and the assembly groove has a triangular structure. The water inlet part and the air inlet part of the water and air intake member are sequentially installed from the entrance of the triangular assembly groove, and the water and air intake member is rotated, so that the position-limiting protrusion cooperates with the assembly hole of the water and air intake member. The position-limiting protrusion is limited and fixed by the assembly hole. The water inlet part and the air inlet part respectively enter two position-limiting ends (first and second ends) of the triangular assembly groove, so that the entire water and air intake member is firmly installed on the base. At the same time, during the process of rotating the water and air intake member, the holding part also abuts against the outer side of the conveyor belt to tension the conveyor belt.

9. The installation method of the spray washing component of the disclosure is simple, without any tools, can be installed with bare hands. In addition, the overall installation cost is low, the efficiency is high, the maintenance and replacement are convenient, and the stability is good, especially after installation when the conveyor belt can be stably abutted against to implement the tensioning function.

BRIEF DESCRIPTION OF THE DRAWINGS

In order to explain the technical solution of the embodiments of the disclosure more clearly, the following briefly introduces the drawings that need to be used in the description of the embodiments.

DETAILED DESCRIPTION OF DISCLOSED EMBODIMENTS

Figure 1:
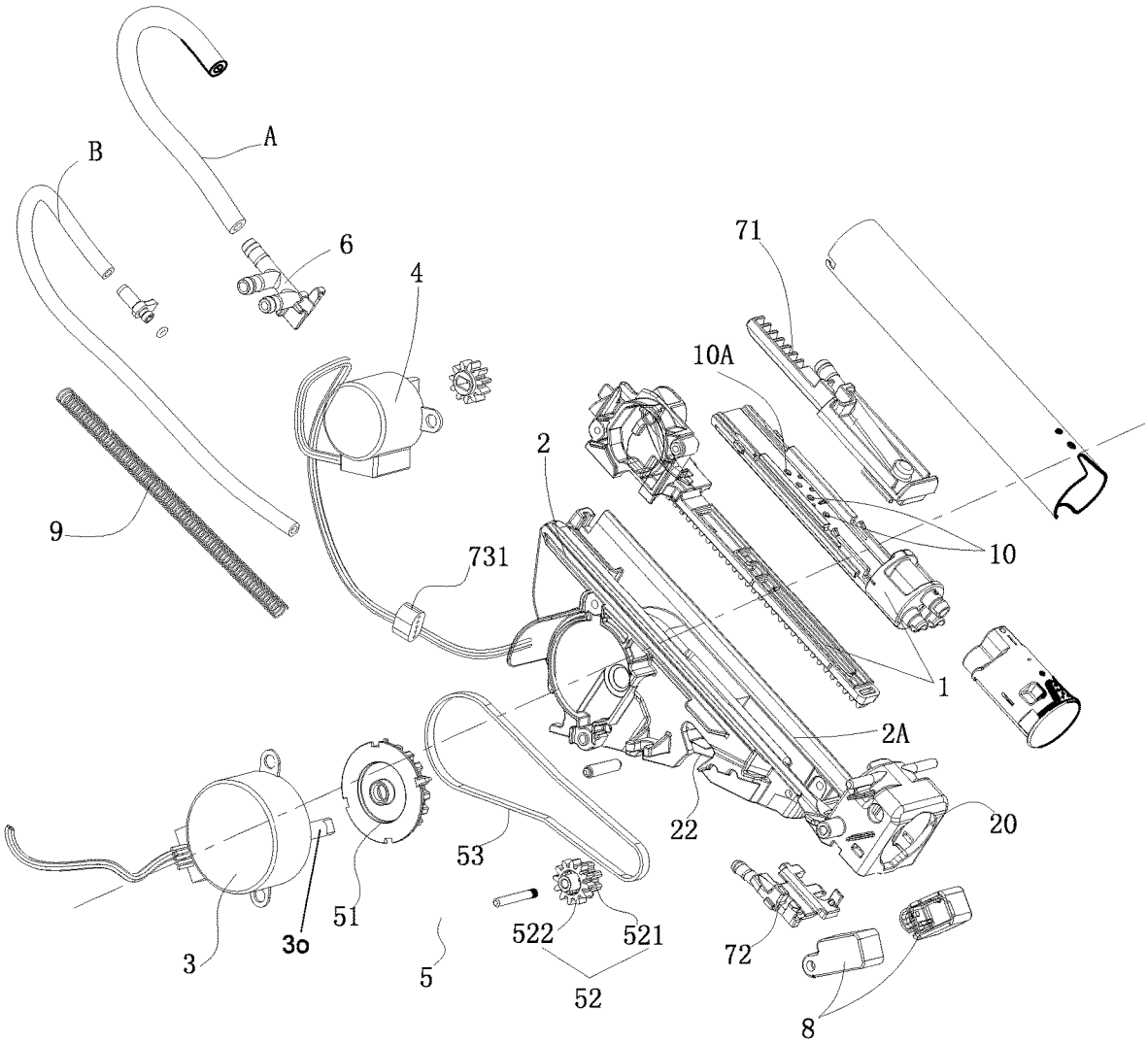
FIG. 1 is a schematic view of a three-dimensional exploded structure of a spray washing component according to an embodiment of the disclosure.
Figure 2:
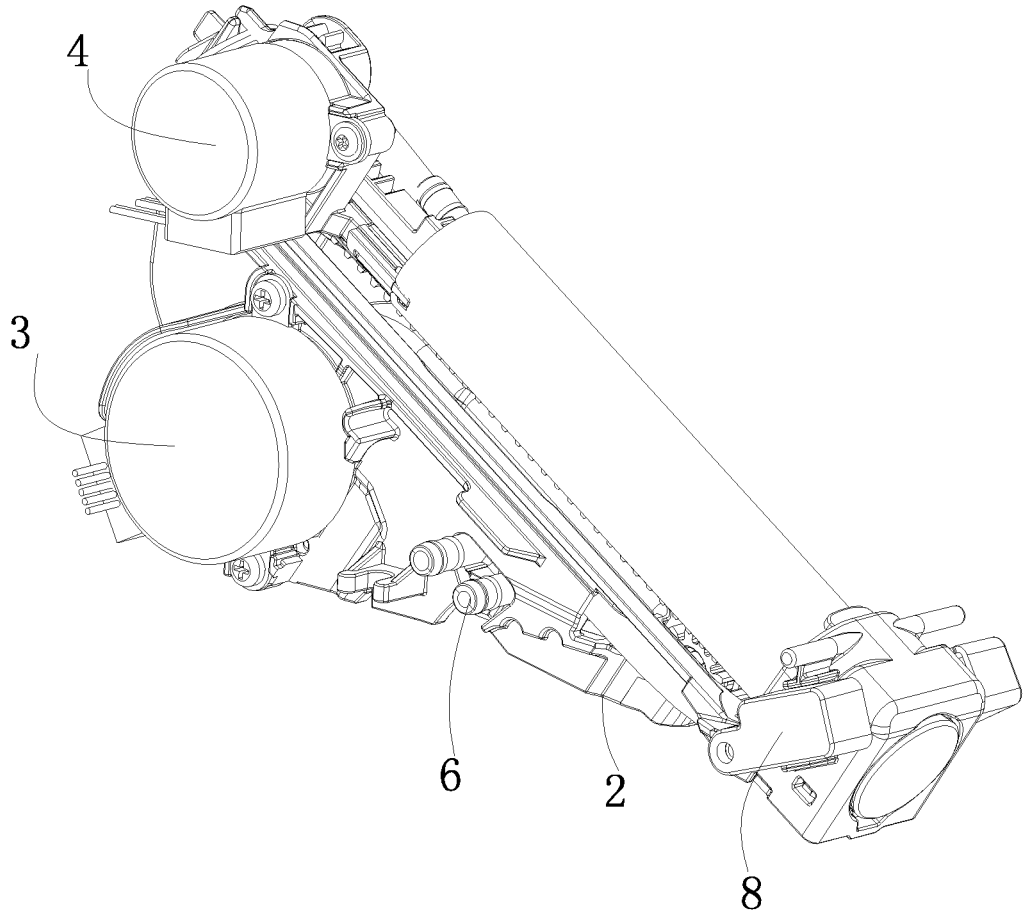
FIG. 2 is a schematic view of a three-dimensional structure of the spray washing component according to an embodiment of the disclosure.
Figure 3:
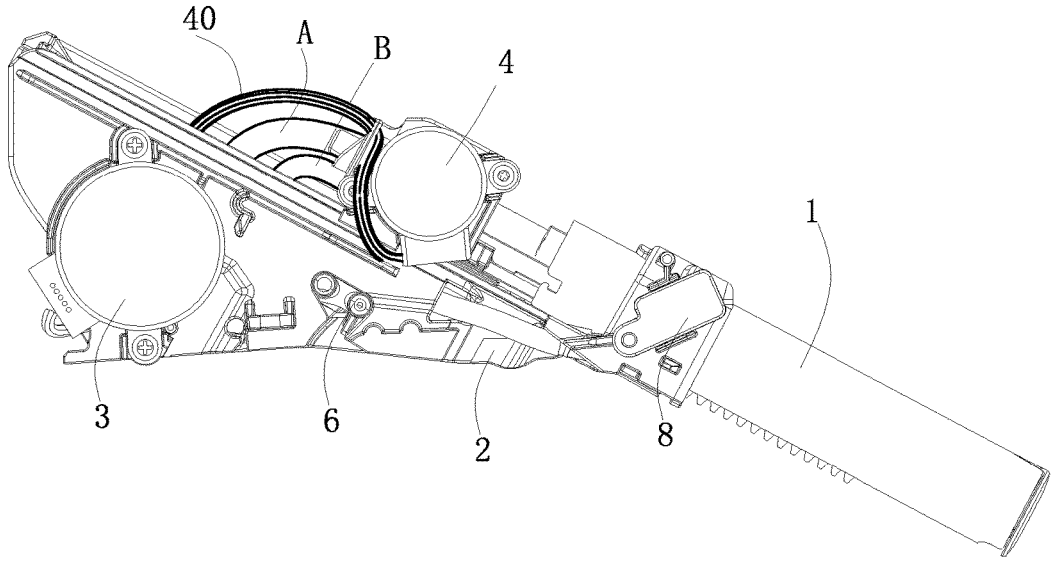
FIG. 3 is a first schematic view of a movement state of the spray washing component according to an embodiment of the disclosure.
Figure 4:
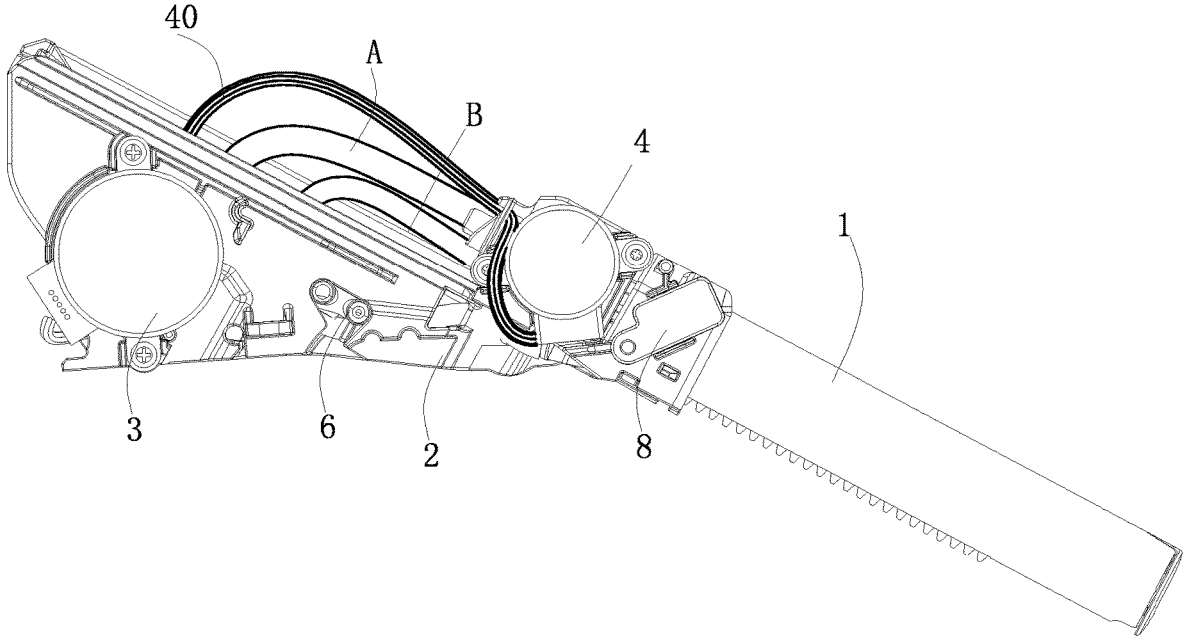
FIG. 4 is a second schematic view of a movement state of the spray washing component according to an embodiment of the disclosure.

The technical solution in the embodiments of the disclosure will be clearly and completely described below in conjunction with the drawings in the embodiments of the disclosure.

Referring to FIG. 1 to FIG. 5, a spray washing component for a smart toilet cover of the disclosure is constructed on the smart toilet cover. A nozzle 1 is driven to extend from the main body of the smart toilet cover to a toilet bowl through a driving device, and sprays clean water to clean the buttocks. The existing smart toilet cover is too thick, too heavy, and occupies a lot of space. The overall existing smart toilet cover offers a thick and heavy visual effect, which is of course not exquisite. One of the important reasons for the thick thickness is that the position where the nozzle 1 extends from the smart toilet cover is provided with a driving motor. The volume of the driving motor plus the volume of the nozzle 1 is the basic thickness that must be first ensured for the smart toilet cover. Based on the thickness, the cover needs more space when being flipped relative to a seat body where the nozzle 1 is installed. Therefore, the height of the entire cover has to be further increased (to be at least flush with the height of the seat body). This is one of the main reasons for the overall thickness of the existing smart toilet cover to be thick and heavy. However, the spray washing component provided by the disclosure effectively solves the defects.

The spray washing component mainly includes the nozzle 1, a base 2, a first motor 3, a second motor 4, a driving gear 51, a dual transmission gear 52, a conveyor belt 53, a water and air intake member 6, a switch body 71, a self-cleaning connector 72, a wire harness structure 73, a sterilization unit 8, and a spring 9.

A guide part 20 formed at an end portion of the base 2, a sliding track 2A, and an accommodating cavity 21 are disposed on the base 2. The accommodating cavity 21 is enclosed by two sidewalls of the base 2, and the two sidewalls are correspondingly provided with an assembly groove 22 and an assembly hole 23 for the water and air intake member 6 to be installed.

The first motor 3 is installed on the base 2 and is away from an end of a jet of the nozzle 1, and drives the nozzle 1 to slide along the base 2 and reciprocate through the guide part 20 through a transmission structure 5.

Figure 5:
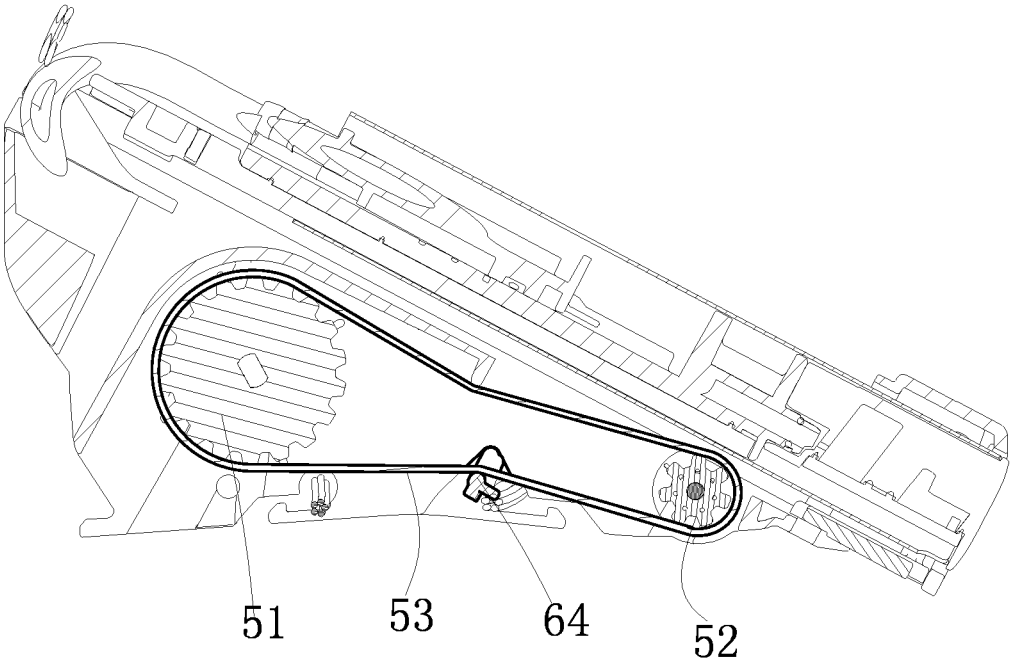
FIG. 5 is a cross-sectional view of a transmission structure part of the spray washing component according to an embodiment of the disclosure.
Figure 6:
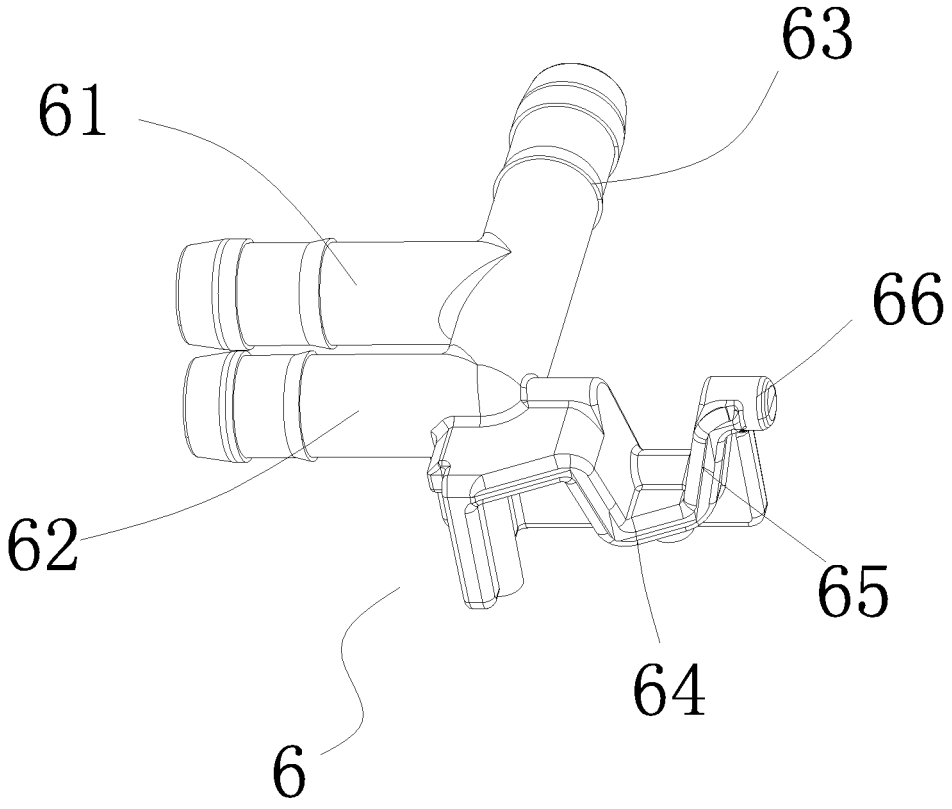
FIG. 6 is a bottom view of the spray washing component according to an embodiment of the disclosure.
Figure 7:
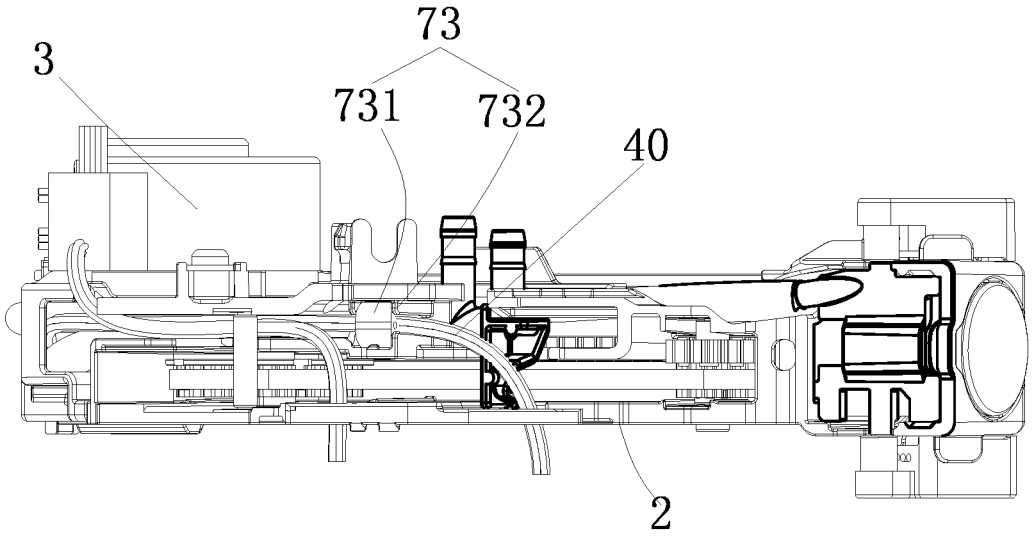
FIG. 7 is a schematic view of a three-dimensional structure of a water and air intake member according to an embodiment of the disclosure.
Figure 8:
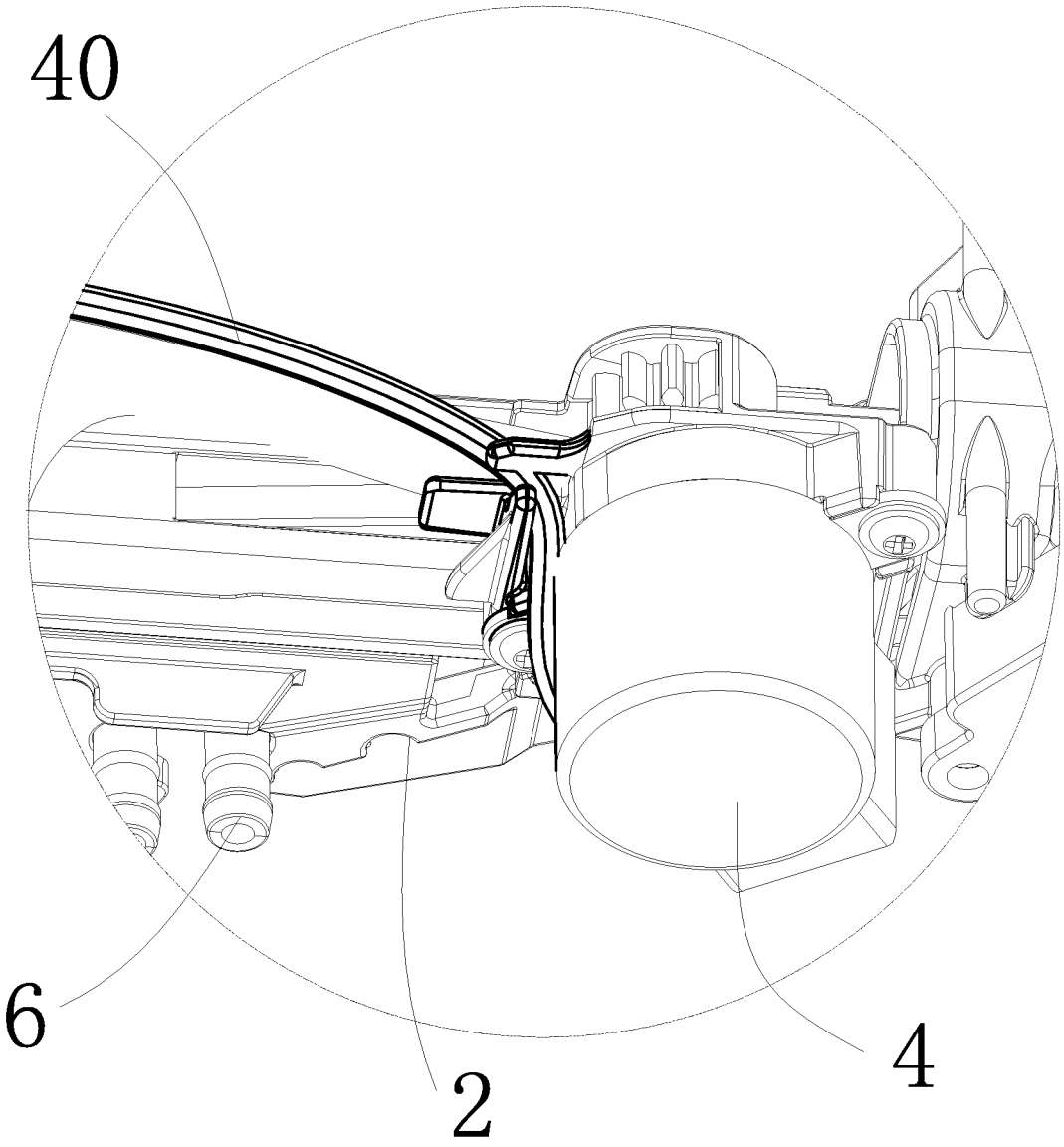
FIG. 8 is a schematic view of a structure of a wire harness structure according to an embodiment of the disclosure.

The transmission structure 5, as shown in FIG. 5, includes the driving gear 51, the dual transmission gear 52, and the conveyor belt 53. The driving gear 51 is in anti-rotation cooperation with an output shaft 3*o* of the first motor 3. The dual transmission gear 52 respectively cooperates with the conveyor belt 53 and a tooth space on the nozzle 1. It should be noted that the nozzle 1 is provided with a rack along an axial direction thereof, and the rack meshes with the dual transmission gear 52. The dual transmission gear 52 of the disclosure includes a primary gear plate 521 and a secondary gear plate 522. The primary and secondary gear plates 521,522 are coaxially disposed and are installed in the accommodating cavity 21 through a rotating shaft, wherein the primary gear plate 521 cooperates with the rack of the nozzle 1, and the secondary gear plate 522 cooperates with the driving gear 51 through the conveyor belt 53 to implement power transmission.

The first motor 3 drives the driving gear 51 to rotate and links the dual transmission gear 52 to rotate through the conveyor belt 53 to drive the nozzle 1 to move along the sliding track 2A of the base 2. The first motor 3 is positioned on a rear end of the base 2 (that is, away from the position of the water outlet of the nozzle 1), so the overall thickness of the toilet cover only needs to meet the height of the nozzle 1, which can easily implement a light and thin smart toilet cover.

On the basis of the reduced thickness, it is also necessary to ensure the implementation of the overall function. The disclosure is also provided with a water diversion unit, which includes the water and air intake member 6, the switch body 71, and the self-cleaning connector 72.

The nozzle 1 is provided with several waterways 10 (the waterways 10 include functions such as buttock washing, feminine washing, self-cleaning, and strong washing), and water inlets of the several waterways 10 could be selectively conducted with a water outlet of the switch body 71. It should be noted that the switch body 71 moves relative to the nozzle 1 through the second motor 4 disposed on the nozzle 1. The second motor 4 and the switch body 71 also adopt a gear and rack structure to implement transmission.

The water and air intake member 6 and the switch body 71 are communicated through a first hose A. It should be noted that the water and air intake member 6 is disposed between the first motor 3 and the guide part 20, so that the required length of the first hose A is the shortest. After a reasonable layout of the length of the first hose A, the overall volume of the nozzle component can be reduced.

The water and air intake member 6 includes a water inlet part 61, an air inlet part 62, a water outlet part 63, a holding part 64, a connecting part 65, and a position-limiting protrusion 66. The water inlet part 61 and the air inlet part 62 are located on one side of the water outlet part 63. The position-limiting protrusion 66 and the connecting part 65 are connected to the other side of the water outlet part 63 through the holding part 64, and the water inlet part 61, the air inlet part 62, the holding part 64, and the position-limiting protrusion 66 are parallel to each other and are all perpendicular to an axial direction of the water outlet part 63. The connecting part 65 is parallel to an axis of the water outlet part 63. It should be noted that one end of the first hose A is connected to the water outlet part 63, and the other end is conducted with the switch body 71. The water and air intake member 6 is installed on the base 2 through an attachment structure, and the holding part 64 of the water and air intake member 6 abuts against the conveyor belt 53 to tension the conveyor belt 53.

The self-cleaning connector 72 is installed under the guide part 20 and is communicated with one of the waterways 10A of the nozzle 1 through a second hose B, that is, when an outer wall of the nozzle 1 needs to be cleaned, the switch body 71 and one of the waterways 10A of the nozzle 1 are conducted, and water flows through the second hose B to the self-cleaning connector 72 and is sprayed from the self-cleaning connector 72 to the outer wall of the nozzle 1 for cleaning.

A curved section of the first hose A is located on an outer side of a curved section of the second hose B (that is to say the curved section of the first hose A is further away from a center of circle roughly defined by a contour of the curved section of the second hose than the curved section of the second hose). Here, the first and second hoses A and B are rubber hoses, which may be bent. The disclosure disposes the first hose A above the second hose B to further reduce the volume of the nozzle component.

In order to prevent the first and second hoses A and B from being entangled along with the displacement of the nozzle 1, the disclosure sets the width of the accommodating cavity 21 to be greater than the outer diameter of one hose and less than the sum of the outer diameters of the two hoses, and the length of the first hose A is greater than the length of the second hose B. The layout is compact and ingenious, and will not interfere with the movement of the nozzle 1. At the same time, the two hoses will not be squeezed, causing water flow to be unsmooth, etc. In addition, the spring 9 is sleeved on the outer wall of the second hose B to prevent the second hose B from being excessively bent. The second hose B is located in an inner diameter range of the first hose A during the process of bending, which is prone to excessive bending. The setting of the spring 9 not only ensures that the second hose B will not be excessively bent, but can also reduce the friction and interference of the first and second hoses A and B even if the first and second hoses A and B collide.

In addition, as shown in FIG. 1 to FIG. 3, FIG. 6, and FIG. 7, a conductive wire 40 of the second motor 4 of the disclosure is arranged in parallel with the first and second hoses A and B and is located on an outer side of the first hose A. The setting enables the conductive wire 40 and the first and second hoses A and B to be parallel and maintain relative positions when the second motor 4 slides along with the nozzle 1, thereby preventing the first and second hoses A and B and the conductive wire 40 from being staggered and entangled. More specifically, the wire harness structure 73 is also disposed to implement anti-entanglement. The wire harness structure 73 includes a wire buckle 731 and an accommodating groove 732. The accommodating groove 732 is formed on a bottom portion of the base 2. The wire buckle 731 is slidably sleeved on the conductive wire 40 and is installed on the accommodating groove 732 to adjust the distance of the conductive wire 40 between the wire buckle 731 and the second motor 4.

The water and air intake member 6 is installed on the bottom portion of the base 2 through the attachment structure and is located between the first motor 3 and the jet of the nozzle 1, and the holding part 64 of the water and air intake member 6 abuts against the conveyor belt 53 to tension the conveyor belt 53. Specifically, the attachment structure includes the assembly groove 22 and the assembly hole 23 opened on the two sidewalls of the accommodating cavity 21 of the base 2.

The assembly groove 22 and the assembly hole 23 are respectively disposed on the two sidewalls of the accommodating cavity 21. The assembly hole 23 is provided for the position-limiting protrusion 66 to be installed, wherein the assembly groove 22 is provided for the water inlet part 61 and the air inlet part 62 to be installed. The assembly groove 22 includes an opening 221 and first and second ends 222 and 223. The opening 221 is disposed on an edge of the sidewall of the base 2, and the opening 221 and the first and second ends 222 and 223 constitute a triangular assembly groove 22. The first and second ends 222 and 223 are respectively provided for the water inlet part 61 and the air inlet part 62 to be installed.

The assembly method of the nozzle component is as follows (as shown in FIG. 1 to FIG. 8).

1. The nozzle 1 is correspondingly installed into a chute of the base 2, so that the nozzle 1 slides along the chute, and the spout of the nozzle 1 is displaced relative to the guide part 20.

2. The first motor 3 is fixed on the sidewall of the base 2, so that the output shaft thereof is in anti-rotation cooperation with the driving gear 51.

3. The dual transmission gear 52 is fixed in the accommodating cavity 21 through a pin or a rotating shaft, so that the primary gear plate 521 meshes with the nozzle 1, and the secondary gear plate 522 cooperates with the driving gear 51 through the conveyor belt 53.

4. The self-cleaning connector 72 is fixed under the guide part 20 and the water outlet thereof is aligned with the nozzle 1. Then, the second hose B with the spring 9 is installed from the accommodating cavity 21, so that the two ends of the second hose B are respectively connected to the nozzle 1 and the self-cleaning connector 72.

5. The second motor 4 is fixed to the nozzle 1, and cooperates with the switch body 71 through a gear transmission group, and drives the switch body 71 to displace relative to the nozzle 1. Then, one end of the first hose A is connected to the switch body 71, and the other end is connected to the water outlet part 63 of the water and air intake member 6.

Figure 9:
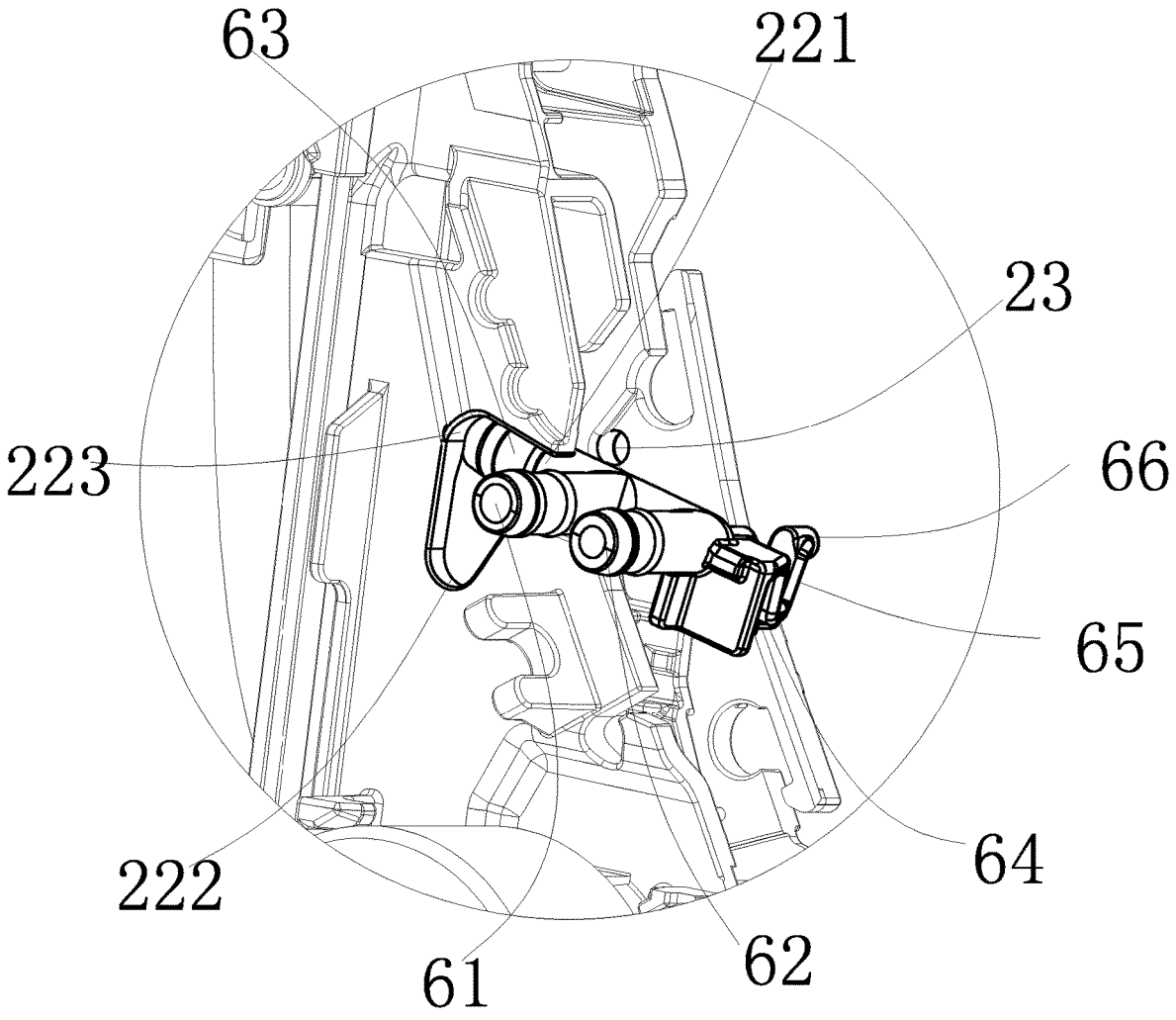
FIG. 9 is a first schematic view of installation of the water and air intake member according to an embodiment of the disclosure.
Figure 10:
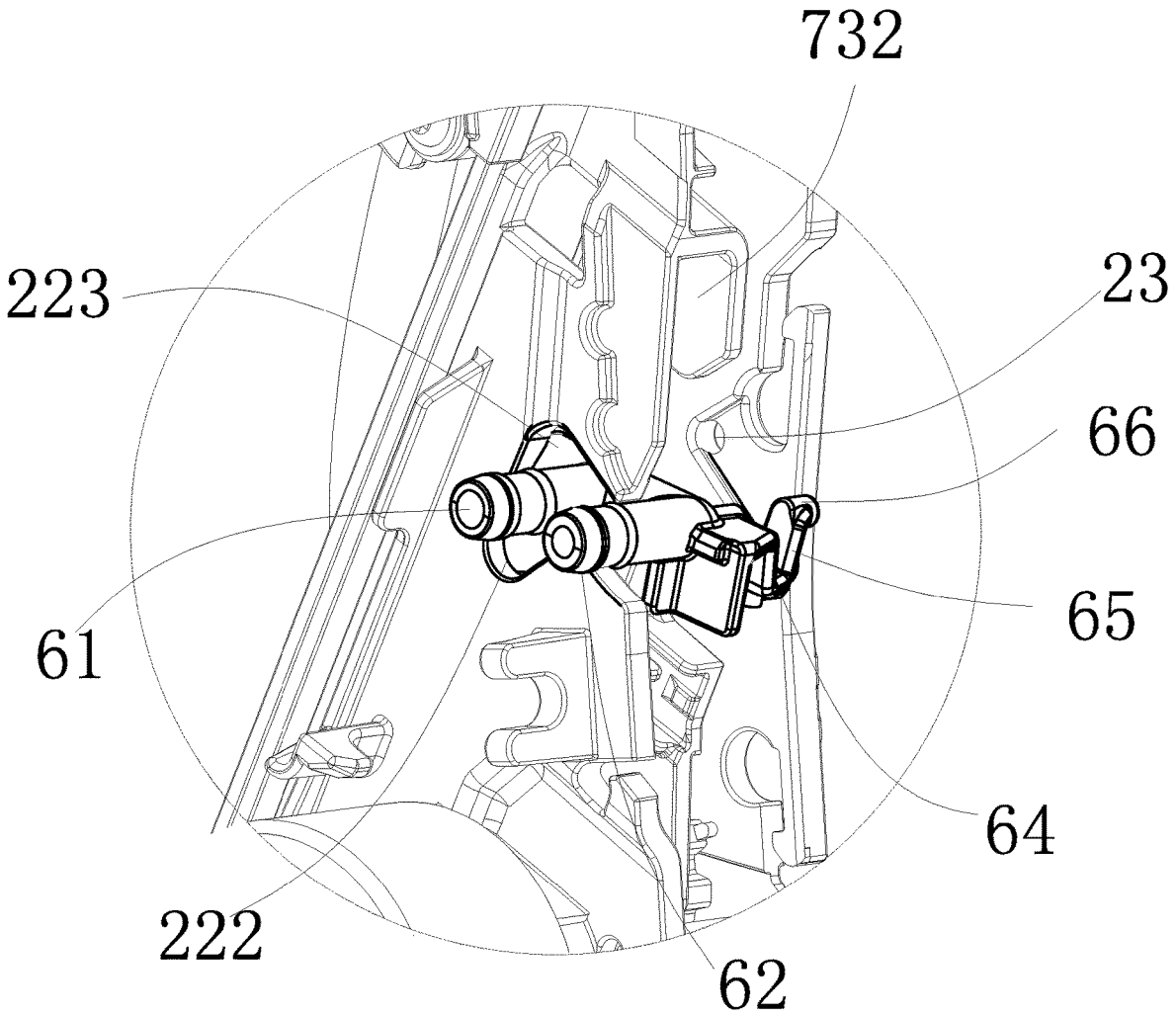
FIG. 10 is a second schematic view of installation of the water and air intake member according to an embodiment of the disclosure.

6. The water inlet part 61 and the air inlet part 62 of the water and air intake member 6 are sequentially installed from the opening 221 on the edge of the sidewall of the base 2. At this time, the water inlet part 61 enters first, and the air inlet part 62 then enters the assembly groove 22 (as shown in FIG. 9) until the water inlet part 61 is displaced to the first end 222, the air inlet part 62 is also located between the opening 221 and the second end 223, and the water outlet part 63, the holding part 64, the connecting part 65, and the position-limiting protrusion 66 are located in the accommodating cavity 21. It should be noted that at this time, the holding part 64 is not abutting against the conveyor belt 53 yet, and the position-limiting protrusion 66 has not entered the assembly hole 23 yet (as shown in FIG. 10).

Figure 11:
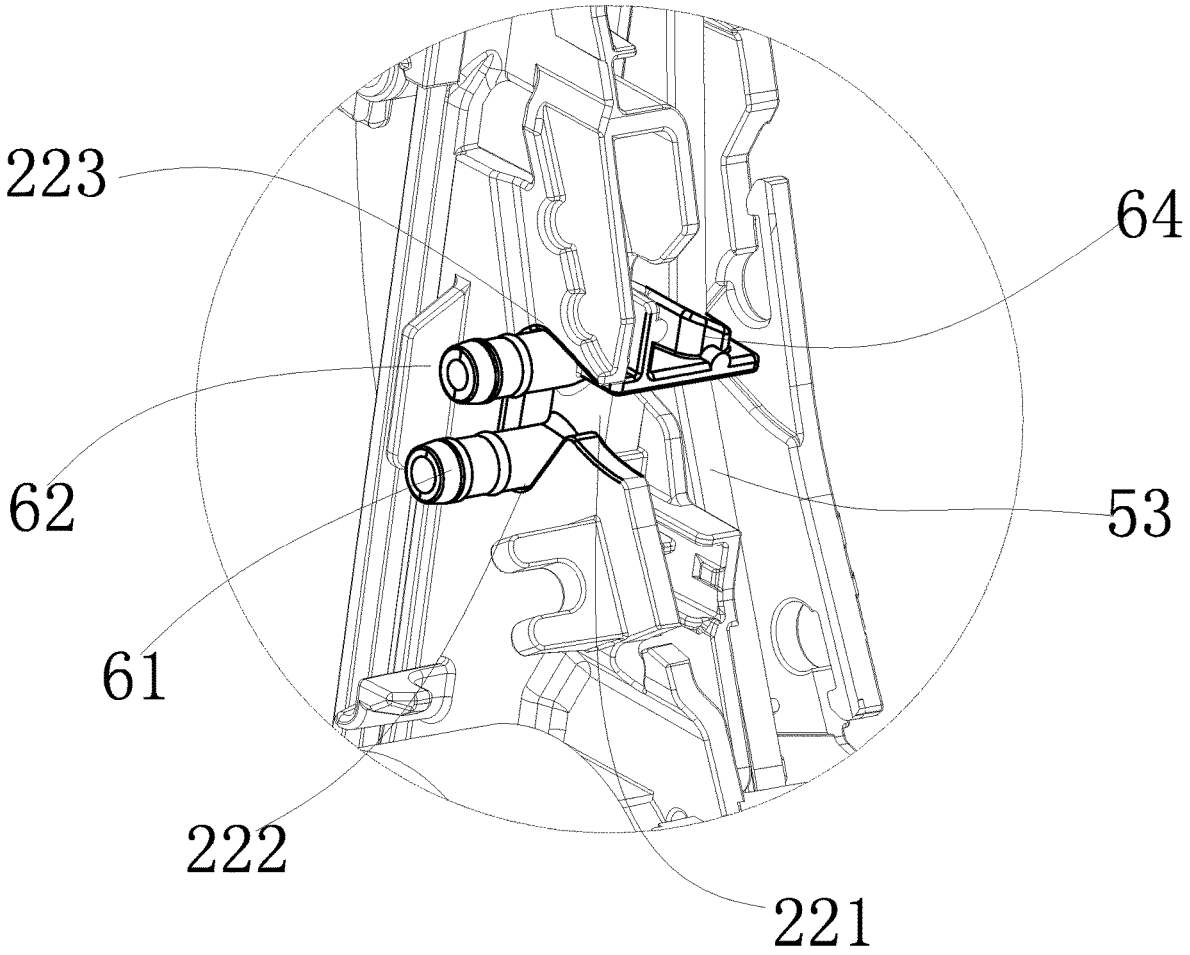
FIG. 11 is a third schematic view of installation of the water and air intake member according to an embodiment of the disclosure.

7. With an axis of the water inlet part 61 located at the first end 222 as an axis (as shown in FIG. 11), the water and air intake member 6 is rotated, so that the air inlet part 62 enters the second end 223 of the assembly groove 22 and the connecting part 65 elastically deforms and drives the position-limiting protrusion 66 to fall into the assembly hole 23. At the same time, the holding part 64 abuts against the outer wall of the conveyor belt 53 due to a certain angle of rotation, so that the conveyor belt 53 is tensioned, and the first hose A is located in the accommodating cavity 21 and above the second hose B.

8. The length (the length refers to the length from the second motor 4 to the wire buckle 731) of the conductive wire 40 of the second motor 4 is adjusted through the wire buckle 731. After the length is adjusted and the conductive wire 40 is disposed above the first hose A, the wire buckle 731 is inserted into a hooking part. Finally, the conductive wire 40, the first hose A, and the second hose B are sequentially arranged from top to bottom, and the relative positions can be maintained during the movement process without entanglement.

9. An ultraviolet germicidal lamp 8 is installed on the guide part 20 to complete the assembly of the entire nozzle component.

In actual use, the first motor 3 receives a signal to turn on and drives the nozzle 1 to slide relative to the base 2 through the transmission of the driving gear 51, the conveyor belt 53, and the dual transmission gear 52. During the movement process, the movement of the nozzle 1 drives the first and second hoses A and B and the conductive wire 40 to deform. Water and air enter through the water and air intake member 6 and are transmitted to the switch body 71 through the first hose A. The switch body 71 is controlled by the second motor 4 to move so as to corresponds to the corresponding waterway 10. The water and air are then ejected through the conducted waterway to finally implement the functions such as buttock washing, feminine washing, self-cleaning, and strong washing.

The description of the foregoing specification and embodiments are used to explain the protection scope of the disclosure, but do not constitute any limitation on the protection scope of the disclosure.

What is claimed is:

1. A spray washing component for a smart toilet cover, comprising: a base, a nozzle, and a first motor, wherein a sliding track is disposed on the base; the nozzle has a rack cooperating with the first motor; and the first motor drives the nozzle to slide along the base, wherein:

the first motor is installed on the base at an end away from a jet of the nozzle and drives the nozzle to be displaced through a transmission structure;

the transmission structure comprises a driving gear, a dual transmission gear, and a conveyor belt; the driving gear is in anti-rotation cooperation with an output shaft of the first motor; the dual transmission gear respectively meshes with the conveyor belt and the rack on the nozzle; and the conveyor belt is disposed around the driving gear and the dual transmission gear, wherein the first motor drives the driving gear to rotate and links the dual transmission gear to rotate through the conveyor belt to drive the nozzle to move along the sliding track of the base, wherein the spray washing component for a smart toilet cover further comprises a water diversion unit, wherein the water diversion unit comprises a water and air intake member, a switch body, and a connector; the nozzle is provided with a plurality of waterways, and water inlets of the plurality of waterways could be selectively conducted with a water outlet of the switch body the water and air intake member is communicated with the switch body through a first hose; and the connector is communicated with one of the waterways of the nozzle through a second hose, wherein a curved section of the first hose is adjacent to a curved section of the second hose.

2. The spray washing component for the smart toilet cover according to claim 1, wherein the base is provided with an accommodating cavity for partially placing the first and second hoses; a width of the accommodating cavity is greater than or equal to an outer diameter of a hose with a largest diameter and is less than a sum of outer diameters of two hoses.

3. The spray washing component for the smart toilet cover according to claim 2, wherein a length of the first hose is greater than a length of the second hose.

4. The spray washing component for the smart toilet cover according to claim 3, further comprising: a second motor, disposed on the nozzle and used to drive the switch body to displace relative to the nozzle, wherein a conductive wire of the second motor is arranged side by side without being staggered with the first and second hoses and is adjacent to the curved section of the first hose.

5. The spray washing component for the smart toilet cover according to claim 4, further comprising: a wire harness structure, used to limit a length of the conductive wire, wherein the wire harness structure comprises a wire buckle and an accommodating groove; the accommodating groove is formed on a bottom portion of the base; and the wire buckle is slidably sleeved on the conductive wire and is installed on the accommodating groove to adjust the length of the conductive wire from the wire buckle to the second motor.

6. The spray washing component for the smart toilet cover according to claim 1, wherein the water and air intake member is disposed at a middle position of the bottom portion of the base and is located between the first motor and the jet of the nozzle.

7. The spray washing component for the smart toilet cover according to claim 6, wherein the water and air intake member comprises a water outlet part, a water inlet part, an air inlet part, a holding part, a connecting part, and a position-limiting protrusion; the water inlet part and the air inlet part are located on one side of the water outlet part, the connecting part and the position-limiting protrusion formed on the connecting part are connected to other side of the water outlet part through the holding part, and the water inlet part, the air inlet part, the holding part, and the position-limiting protrusion are parallel to each other and are all perpendicular to an axial direction of the water outlet part; and the connecting part is parallel to an axis of the water outlet part, wherein the water and air intake member is installed on the base through an attachment structure, and the holding part abuts against the conveyor belt to tension the conveyor belt.

8. The spray washing component for the smart toilet cover according to claim 7, wherein the attachment structure comprises an assembly groove and an assembly hole; the assembly groove and the assembly hole are respectively disposed on two sidewalls of the accommodating cavity; and the assembly hole is provided for the position-limiting protrusion to be installed, wherein the assembly groove is provided for the water inlet part and the air inlet part to be installed and includes an opening and first and second ends; the opening is disposed on a bottom portion of a sidewall of the base, and the opening and the first and second ends constitute a triangular assembly groove; the first end is provided for the air inlet part or the water inlet part to be installed; and the second end is provided for the water inlet part or the air inlet part to be installed.

9. An assembly method of a spray washing component, wherein the spray washing component comprises a base, a motor, a conveyor belt, a nozzle, and a water and air intake member; the base has an accommodating cavity for the conveyor belt to be placed; the motor is installed on the base and drives the nozzle to slide relative to the base through the conveyor belt; an assembly groove and an assembly hole are disposed on two sidewalls of the accommodating cavity, wherein the assembly groove comprises an opening and first and second ends; the opening is opened on an edge of a sidewall of the base and constitutes a triangular assembly groove with the first and second ends; the water and air intake member comprises a water outlet part, a water inlet part, an air inlet part, a holding part, a connecting part, and a position-limiting protrusion; the water inlet part and the air inlet part are located on one side of the water outlet part, the connecting part and the position-limiting protrusion are connected to other side of the water outlet part through the holding part, and the water inlet part, the air inlet part, the holding part, and the position-limiting protrusion are parallel to each other and are all perpendicular to an axial direction of the water outlet part; and the connecting part is parallel to an axis of the water outlet part;

the assembly method comprises:

sequentially disposing the water inlet part and the air inlet part of the water and air intake member into the assembly groove from the opening until the water inlet part is displaced to the first end, the air inlet part is also located between the opening and the second end, and the water outlet part, the holding part, the connecting part, and the position-limiting protrusion are located in the accommodating cavity; and rotating the water and air intake member with an axis of the water inlet part as an axis, so that the air inlet part enters the second end of the assembly groove, and the connecting part elastically deforms and links the position-limiting protrusion to fall into the assembly hole, and at this time, the holding part abuts against an outer wall of the conveyor belt to tension the conveyor belt.

10. The spray washing component for the smart toilet cover according to claim 2, wherein the water and air intake member is disposed at a middle position of the bottom portion of the base and is located between the first motor and the jet of the nozzle.

11. The spray washing component for the smart toilet cover according to claim 3, wherein the water and air intake member is disposed at a middle position of the bottom portion of the base and is located between the first motor and the jet of the nozzle.

12. The spray washing component for the smart toilet cover according to claim 4, wherein the water and air intake member is disposed at a middle position of the bottom portion of the base and is located between the first motor and the jet of the nozzle.

13. The spray washing component for the smart toilet cover according to claim 5, wherein the water and air intake member is disposed at a middle position of the bottom portion of the base and is located between the first motor and the jet of the nozzle.

* * * * *